US010582760B1

(12) United States Patent
Kardoosh

(10) Patent No.: US 10,582,760 B1
(45) Date of Patent: Mar. 10, 2020

(54) CONTAINER POURING ASSIST SYSTEM

(71) Applicant: James Kardoosh, Chesterfield, MI (US)

(72) Inventor: James Kardoosh, Chesterfield, MI (US)

( * ) Notice: Subject to any disclaimer, the term of this patent is extended or adjusted under 35 U.S.C. 154(b) by 0 days.

(21) Appl. No.: 16/127,294

(22) Filed: Sep. 11, 2018

(51) Int. Cl.

| | |
|---|---|
| ***A45F 5/10*** | (2006.01) |
| ***B65D 23/10*** | (2006.01) |
| ***B65D 23/00*** | (2006.01) |
| ***B65D 23/08*** | (2006.01) |
| ***B65D 47/06*** | (2006.01) |
| ***B65D 41/04*** | (2006.01) |
| *A47G 23/02* | (2006.01) |

(52) U.S. Cl.
CPC ..... *A45F 5/102* (2013.01); *B65D 23/001* (2013.01); *B65D 23/0871* (2013.01); *B65D 23/106* (2013.01); *B65D 41/04* (2013.01); *B65D 47/065* (2013.01); *A45F 2005/1006* (2013.01); *A47G 23/0241* (2013.01)

(58) Field of Classification Search
CPC ..... A45F 5/102; A45F 2005/1006; B65D 23/001; B65D 23/0871; B65D 23/106; B65D 41/04; B65D 47/065; B65D 25/2817; A47G 23/0241; A47G 23/0233; A47G 23/02; A47G 23/0216; A47G 23/025; A47G 23/0258; A47G 23/0266; A47J 45/075; A47J 45/077; A47J 45/078
USPC ..... 220/742, 737, 740, 741, 375; 294/32, 294/27.1, 33, 31.2; 215/396, 395, 398, 215/399; 222/565, 572
See application file for complete search history.

(56) References Cited

U.S. PATENT DOCUMENTS

| | | | | |
|---|---|---|---|---|
| 1,242,994 A | | 10/1917 | Skiff | |
| 1,447,838 A | * | 3/1923 | Donaldson | A01J 15/06 215/382 |
| 1,811,080 A | | 6/1931 | William | |
| 2,188,184 A | | 1/1940 | Hogg | |
| 3,719,305 A | * | 3/1973 | Pressnell | A47G 23/0233 220/740 |
| 4,132,225 A | * | 1/1979 | Whattam | A61B 5/15003 215/306 |
| 4,842,158 A | | 6/1989 | Reyes, Jr. | |
| 4,982,869 A | | 1/1991 | Robbins, III | |
| 5,454,483 A | * | 10/1995 | Ichikawa | A47G 23/0258 220/495.01 |

(Continued)

FOREIGN PATENT DOCUMENTS

EP 0652158 5/1995

*Primary Examiner* — Andrew D Perreault

(57) ABSTRACT

The container pouring assist system is a covering for a container that makes the container easier to pour by adding a handle to the bottom rear of the container and a spout to the top of the container. As non-limiting examples, the container may be a heavier container such as a 1 or 2 gallon milk and water container. Using the container pouring assist system the container may be lifted using the container's handle and then tilted using the handle provided by container pouring assist system. The spout may result in a more controlled, more predictable pour. The container pouring assist system may slip onto the container by placing a collar over the neck of the container and passing the base of container pouring assist system under the container until the container seats into the base.

13 Claims, 5 Drawing Sheets

(56) References Cited

U.S. PATENT DOCUMENTS

| | | | | |
|---|---|---|---|---|
| 5,490,658 | A * | 2/1996 | Coward | A61M 5/1417 215/399 |
| D397,940 | S | 9/1998 | Safarian | |
| D404,564 | S * | 1/1999 | Rausch | D3/229 |
| 6,651,838 | B2 | 11/2003 | Bissell | |
| 8,752,720 | B1 * | 6/2014 | Habig | B65D 55/16 215/306 |
| 9,107,489 | B1 | 8/2015 | Wisniewski | |
| D764,162 | S * | 8/2016 | Seda | D3/202 |
| 2001/0040380 | A1 * | 11/2001 | Forjone | B65D 23/106 294/31.2 |
| 2007/0012651 | A1 * | 1/2007 | Williamson | A47G 23/0241 215/396 |
| 2013/0306635 | A1 * | 11/2013 | Crevin | A47G 23/0258 220/254.2 |
| 2013/0313272 | A1 * | 11/2013 | Jarvis | B65D 23/0885 220/737 |

* cited by examiner

CONTAINER POURING ASSIST SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of containers, more specifically, a container pouring assist system.

SUMMARY OF INVENTION

The container pouring assist system is a covering for a container that makes the container easier to pour by adding a handle to the bottom rear of the container and a spout to the top of the container. As non-limiting examples, the container may be a heavier container such as a 1 or 2-gallon milk and water container. Using the container pouring assist system the container may be lifted using the container's handle and then tilted using the handle provided by container pouring assist system. The spout may result in a more controlled, more predictable pour. The container pouring assist system may slip onto the container by placing a collar over the neck of the container and passing the base of container pouring assist system under the container until the container seats into the base.

An object of the invention is to make it easier to pour from a container.

Another object of the invention is to add a handle at the bottom rear of the container.

A further object of the invention is to add a spout to the top of the container.

Yet another object of the invention is to couple to the container by capturing the container between a collar at the top and a base at the bottom.

These together with additional objects, features and advantages of the container pouring assist system will be readily apparent to those of ordinary skill in the art upon reading the following detailed description of the presently preferred, but nonetheless illustrative, embodiments when taken in conjunction with the accompanying drawings.

In this respect, before explaining the current embodiments of the container pouring assist system in detail, it is to be understood that the container pouring assist system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the container pouring assist system.

It is therefore important that the claims be regarded as including such equivalent construction insofar as they do not depart from the spirit and scope of the container pouring assist system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
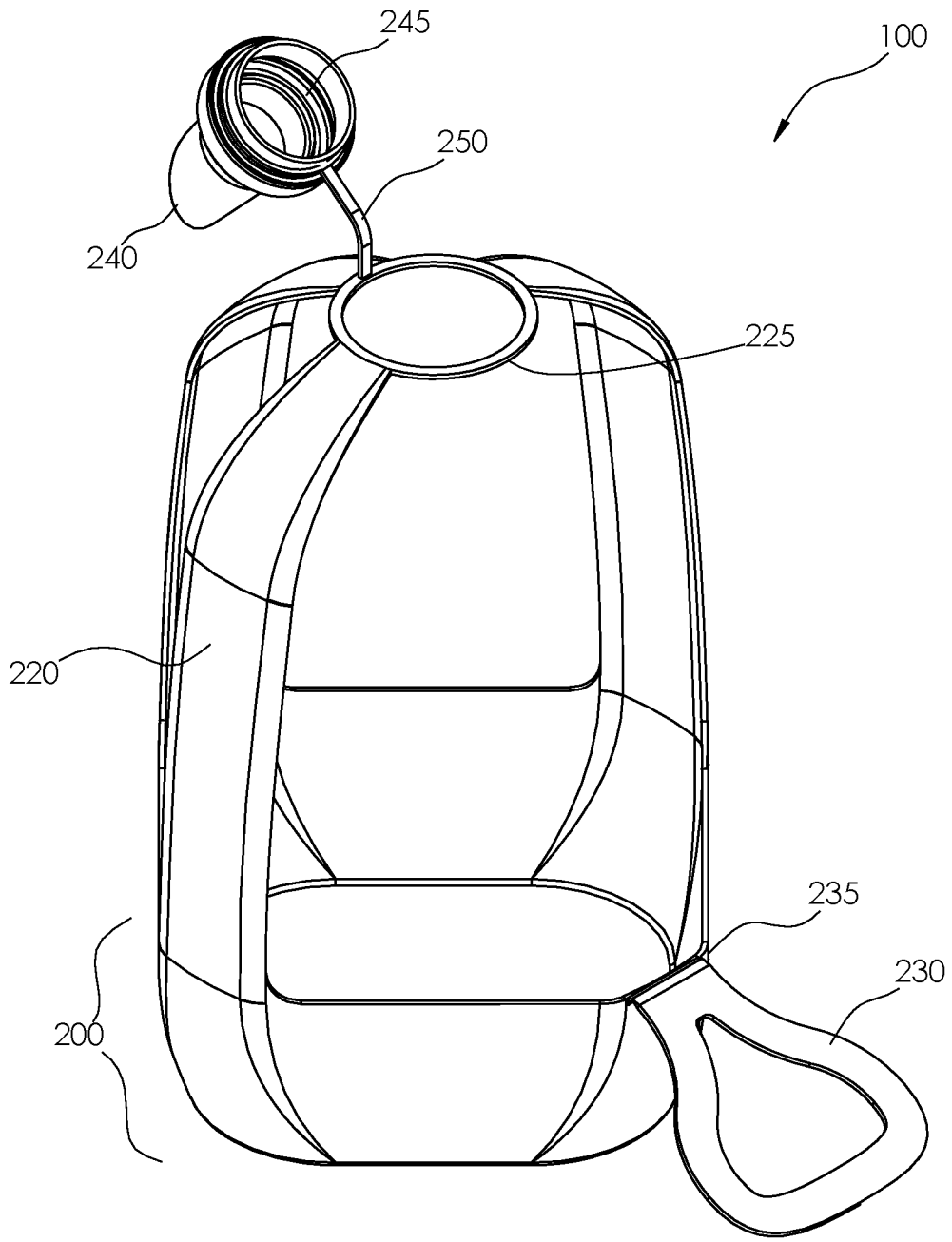
FIG. 1 is a perspective view of an embodiment of the disclosure.
Figure 2:
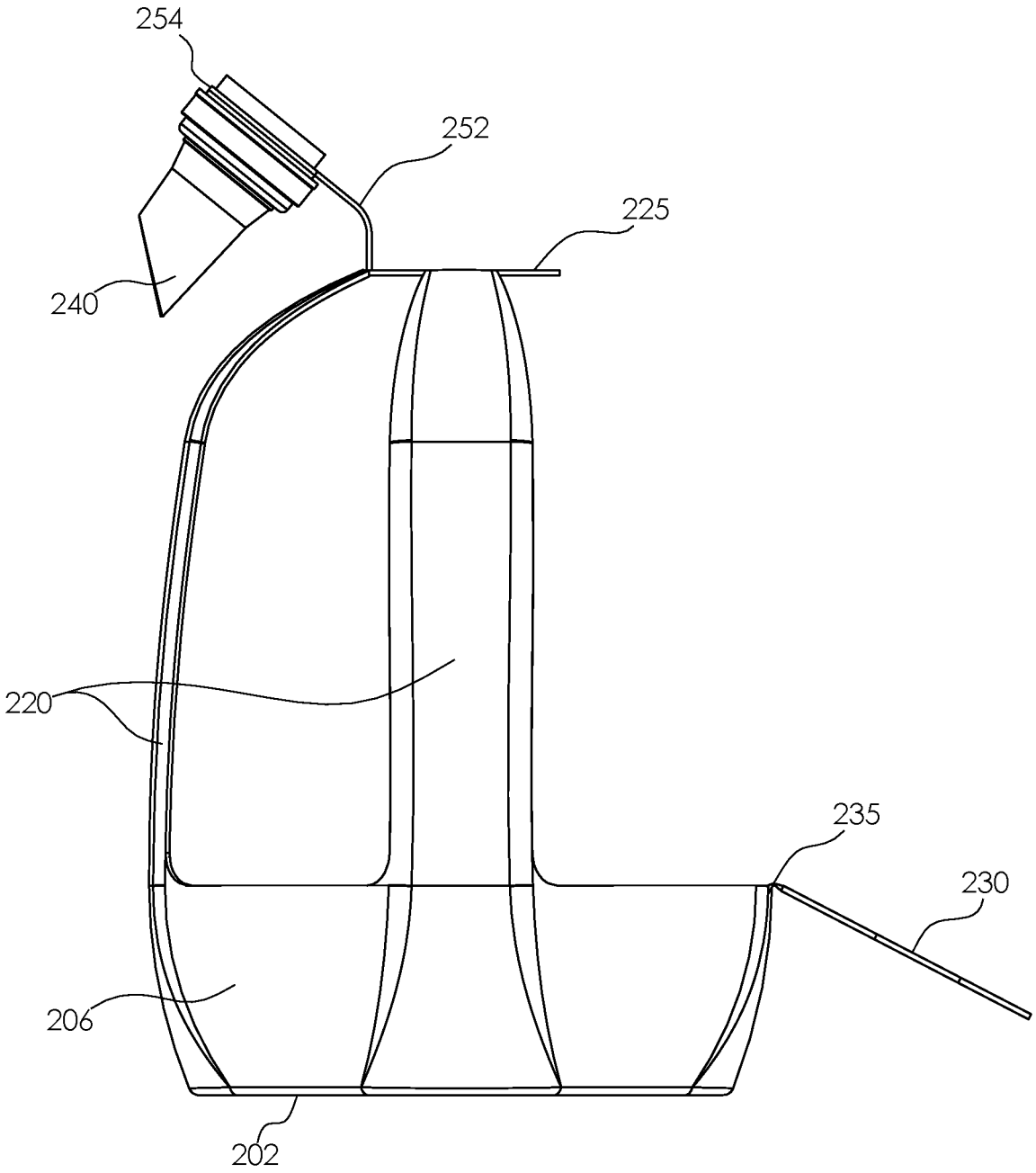
FIG. 2 is a side view of an embodiment of the disclosure.
Figure 3:
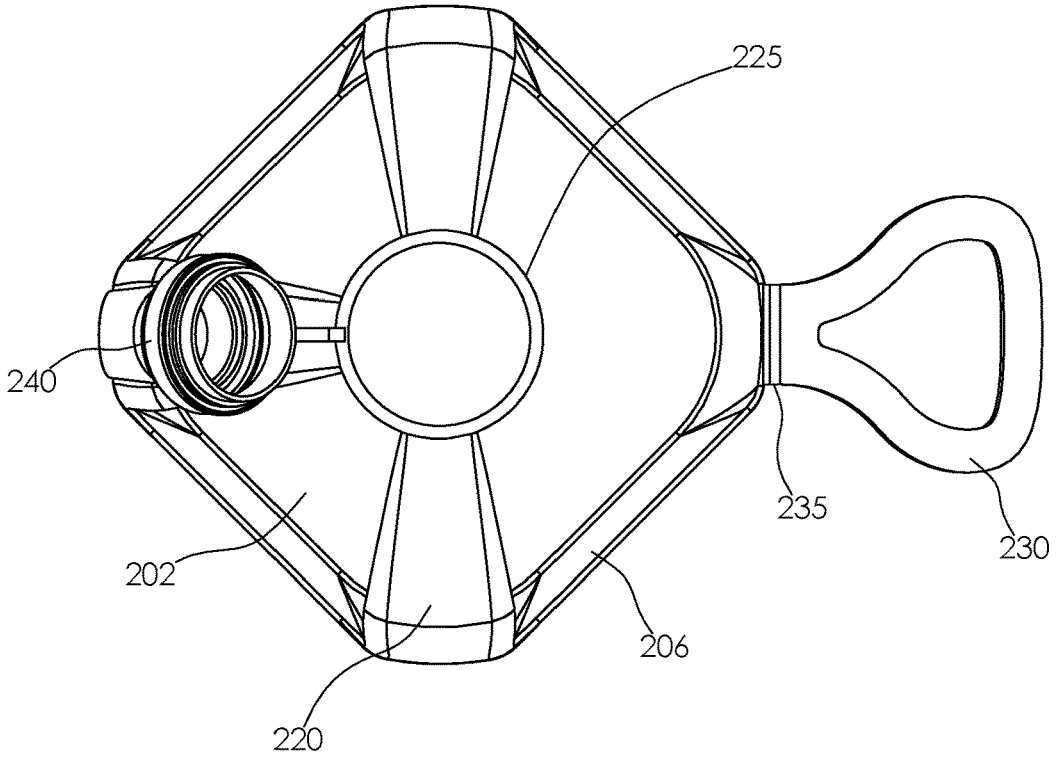
FIG. 3 is a top view of an embodiment of the disclosure.
Figure 4:
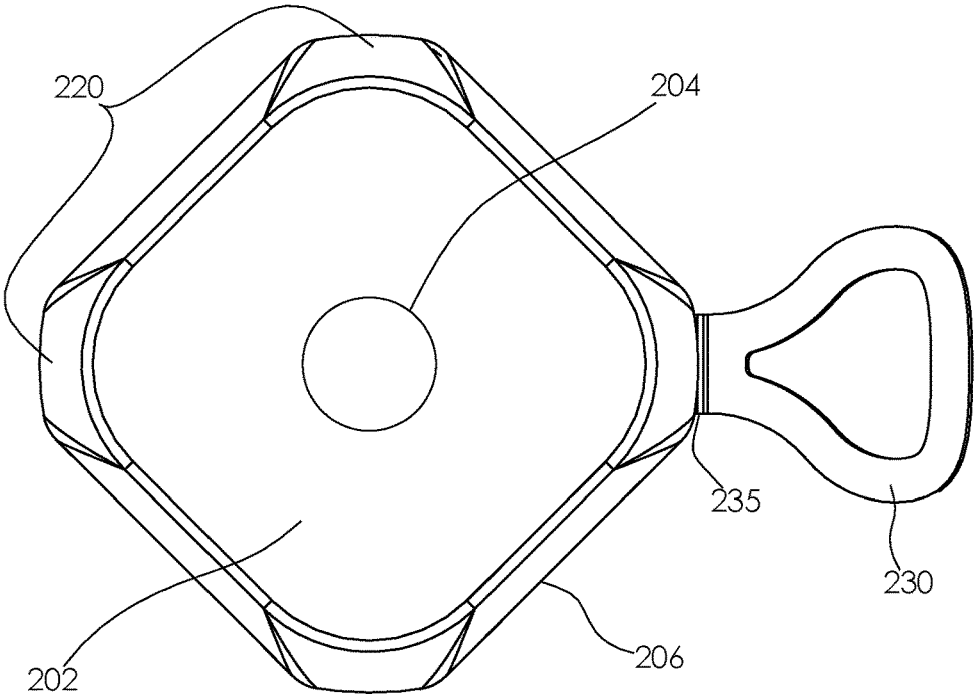
FIG. 4 is a bottom view of an embodiment of the disclosure.
Figure 5:
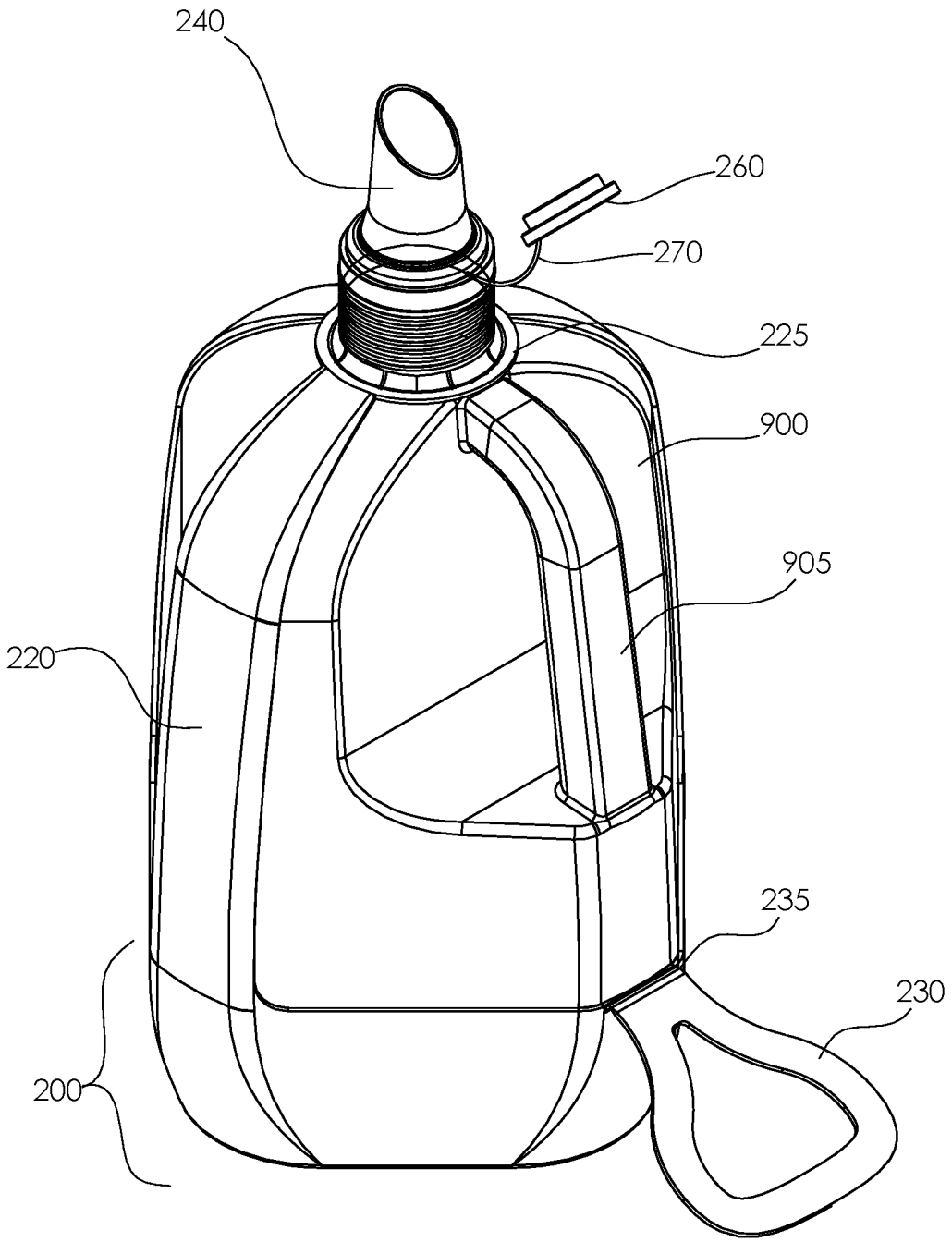
FIG. 5 is an in-use perspective view of an embodiment of the disclosure illustrating the invention coupled to a container.
Figure 6:
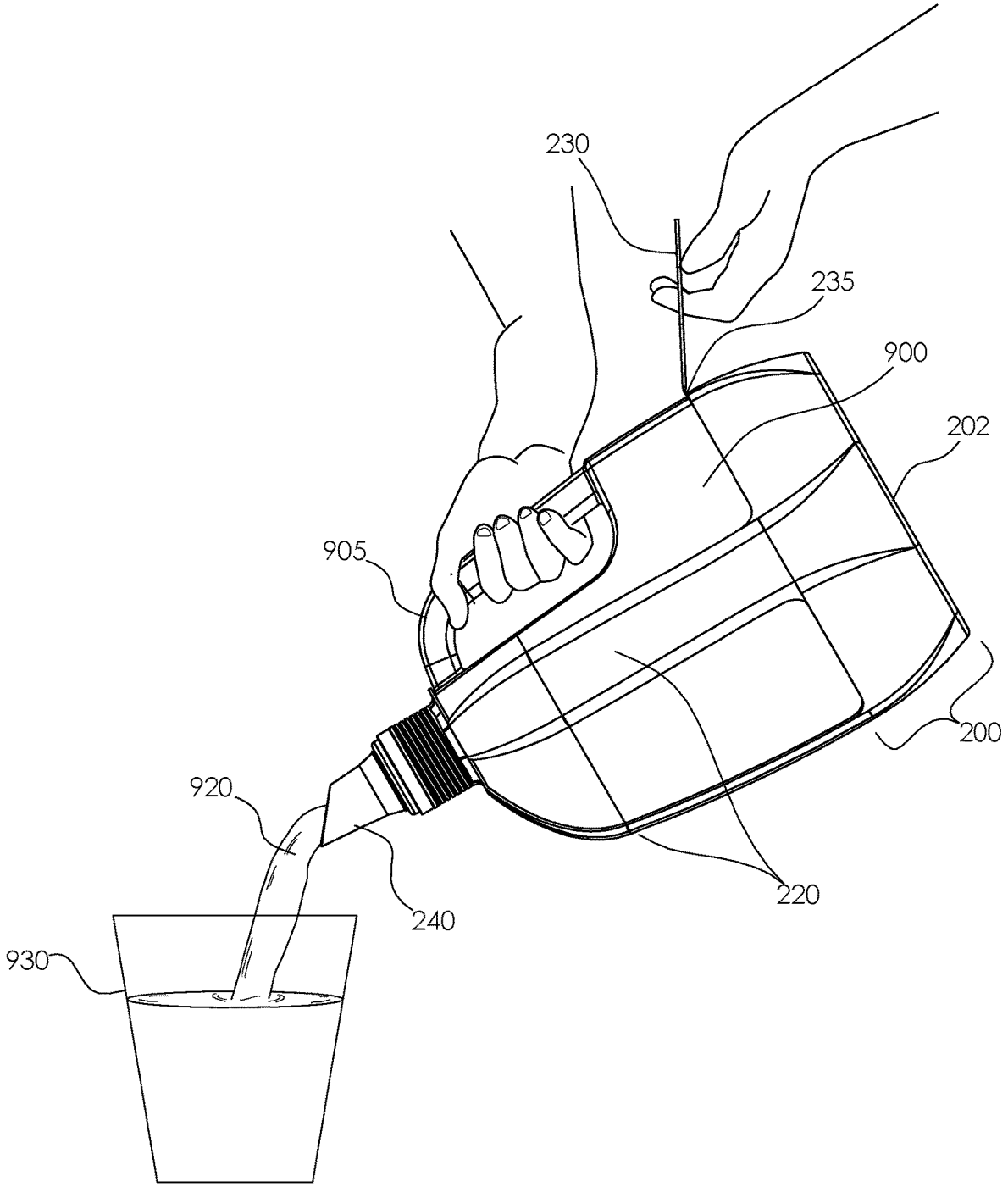
FIG. 6 is an in-use view of an embodiment of the disclosure illustrating the invention being used to pour from a container.

Detailed reference will now be made to a first potential embodiment of the disclosure, which is illustrated in FIGS. 1 through 6.

The container pouring assist system 100 (hereinafter invention) comprises a base 200, a plurality of side supports 220, a collar 225, a handle 230, and a spout 240. The invention 100 is a covering for a milk container 900 that makes contents 920 of the milk container 900 easier to pour by adding the handle 230 to the bottom rear of the milk container 900 and the spout 240 to the top of the milk container 900. As non-limiting examples, the milk container 900 may be a one-gallon plastic container of the type commonly used to distribute milk and water.

Throughout this document, directional references such as front and rear use the frame of reference of the milk container 900. Specifically, the rear of the milk container 900 is the corner of the milk container 900 where a container handle 905 is located. Front is then defined to be the corner of the milk container 900 that is opposite the rear, which is also the direction that the contents 920 of the milk container 900 are poured when the milk container 900 is tilted using the container handle 905. Left and right are further defined from the point of view of an observer located behind the milk contained 900 and looking towards the front of the milk container 900—left is on the observer's left and right is on the observer's right.

The base 200 comprises a bottom panel 202 and base sides 206. The base 200 may provide support for the bottom of the milk container 900 and may prevent the milk container 900 from slipping through the invention 100 and falling out of the bottom of the invention 100. The plurality of side supports 220 may couple to the top of the base 200.

The bottom panel 202 may be a substantially flat panel. The bottom panel 202 may be coupled at its edges to the base sides 206. In some embodiments, the base 200 may compromise one or more base apertures 204. The one or more base apertures 204 may be holes that are cut, molded, stamped, or otherwise formed in the bottom panel 202. The one or more base apertures 204 may allow air to flow into or out of the space between the base 200 and the milk container 900. The inability of air to flow into or out of the space between the base 200 and the milk container 900 could otherwise make it difficult to install or remove the milk container 900 from the base 200.

The base sides 206 may surround the bottom of the milk container 900 when the milk container 900 is installed in the invention 100. The base sides 206 may prevent the milk container 900 from slipping out of the base 200 in a lateral direction. The base sides 206 may be a single side that encircles the milk container 900 or the base sides 206 may be multiple, separate panels that couple to each other at their lateral edges. The bottom edge of the base sides 206 couple to the bottom panel 202. The plurality of side supports 220 may couple to the top of the base sides 206 at three corners of the base 200.

The plurality of side supports 220 may be straps that couple the base 200 to the collar 225. The plurality of side supports 220 may cover container corners at the front, left, and right corners. The bottom of the plurality of side supports 220 couple to the base 200. The top of the plurality of side supports 220 couple to the collar 225. In some embodiments, the plurality of side supports 220 may be made from an elastic material such that the plurality of side supports 220 may stretch to allow the base 200 to pass over the bottom of the milk container 900 during installation and removal.

The collar 225 may be a ring that surrounds a neck of the milk container 900. The collar 225 may support the upper end of the plurality of side supports 220. The plurality of side supports 220 may pull the collar 225 downwards while pulling the base 200 upwards, thus sandwiching the milk container 900 between the collar 225 and the base 200. The collar 225 may be prevented from sliding down due to the widening of the milk container 900 below the neck. The base 200 may be prevented from lifting due to the bottom panel 202 pressing against the bottom of the milk container 900.

The handle 230 may be a hand hold located on the base 200 at the top of the rear corner. The handle 230 may provide a grasping point to assist in tilting the milk container 900. The handle 230 may pivotably couple to the base 200 via a handle hinge 235.

The spout 240 may be a nozzle that couples to the top of the milk container 900 to direct the flow of the contents 920 as the contents 920 are poured from the milk container 900. As non-limiting examples, the spout 240 may have a circular, ellipsoidal, or triangular cross-section. In some embodiments, the spout 240 may couple to the milk container 900 by screwing a threaded base 245 onto the top of the milk container 900.

A spout retainer 250 may prevent loss of the spout 240 at times when the spout 240 is removed from the milk container 900. As a non-limiting example, the spout 240 may be removed from the milk container 900 when the milk container 900 is empty and must be replaced by another container. The spout retainer 250 may retain the spout 240 to the collar 225. The spout retainer 250 may comprise a retaining ring 254 and a retaining strap 252. The retaining ring 254 may slidably couple to bottom of the spout 240 such that the retaining ring 254 is held onto the spout 240 and the spout 240 may rotate within the retaining ring 254. One end of the retaining strap 252 may couple to the collar 225. The opposite end of the retaining strap 252 may couple to the retaining ring 254. The spout 240 may be coupled to the top of the milk container 900 by pivoting the spout 240 on the spout retainer 250 until the threaded base 245 is aligned with the top of the milk container 900 and then screwing the threaded base 245 onto the milk container 900 with the spout 240 free to rotate within the retaining ring 254 while being screwed.

In some embodiments, the invention 100 may comprise a cap 260 that covers the end of the spout 240. The cap 260 may prevent contamination of the contents 920 of the milk container 900 from objects falling into the spout 240. The cap 260 may prevent spills or splashing of the contents 920 out of the milk container 900. The cap 260 may insert into the top end of the spout 240 and provide a top cover that blocks the open end of the spout 240. The cap 260 may be held in place by an interference fit between the cap 260 and the spout 240.

A cap retainer 270 may retain the cap 260 to the spout 240 when the cap 260 is removed from the spout 240. As a non-limiting example, the cap 260 may be removed from the spout 240 for the purpose of pouring the contents 920 of the milk container 900 from the spout 240. The cap retainer 270 may couple to the cap 260 at one end of the cap retainer 270 and to the spout 240 at the opposite end of the cap retainer 270.

In use, the milk container 900 may be placed into the invention 100 by first orienting the invention 100 such that the plurality of side supports 220 are aligned with the front, left, and right corners of the milk container 900. Next, the collar 225 is lowering over the top of the milk container 900. Then, the base 200 may be tipped by raising the front corner of the base 200 and lowering the rear corner of the base 200. The base 200 may then be pulled rearward, sliding over the bottom of the milk container 900 and returning to the non-tilted position as the milk container 900 moves into the base 200. When the base 200 covers the bottom of the milk container 900, the milk container 900 may be set down. The spout 240 may then be screwed onto the top of the milk container 900 and the cap 260 may be put in placed on top of the spout 240.

The contents 920 of the milk container 900 may be poured by removing the cap 260 and lifting the milk container 900 using the container handle 905. The handle 230 may then be used to tip the milk container 900 forward to pour the contents 920 into a cup 930 through the spout 240.

The invention 100 may be removed from the milk container 900 by reversing the steps stated above.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used in this disclosure, a "collar" is a ring like device that is placed around an object.

As used herein, the words "couple", "couples", "coupled" or "coupling", refer to connecting, either directly or indirectly, and does not necessarily imply a mechanical connection.

As used in this disclosure, a "cross-section" is a surface or shape that would be exposed by making a straight cut through an object.

As used in this disclosure, "elastic" refers to a material or object that deforms when a force is applied to it and that is able to return to its relaxed shape after the force is removed. A material that exhibits these qualities is also referred to as an elastomeric material.

As used in this disclosure, a "handle" is an object by which a tool, object, or door is held or manipulated with the hand.

As used in this disclosure, a "hinge" is a device that permits the turning, rotating, or pivoting of a first object relative to a second object.

As used herein, "interference fit", also known as "friction fit" or "press fit", refers to a fastening between two parts that is achieved by friction between the parts when the parts are pressed together.

As used in this disclosure, the word "lateral" refers to the sides of an object or movement towards a side. Lateral directions are generally perpendicular to longitudinal directions. "Laterally" refers to movement in a lateral direction.

As used herein, a "lateral edge" or "lateral end" is an edge or end that is reached when traversing an object in a lateral direction.

As used herein, the word "substantially" indicates that two or more attributes are the same except for a margin of error related to variances in materials, manufacturing processes, craftsmanship, installation, environmental conditions, or other factors that may influence the attributes and that the differences introduced by these factors are not considered detrimental to the operation of the invention as described herein.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A container pouring assist system comprising:

a base, a plurality of side supports, a collar, a handle, a spout, a rear corner of the base on a rear corner of the container pouring assist system, a front corner of the base on a front corner of the container pouring assist system, a left corner of the base on a left corner of the container pouring assist system, and a right corner of the base on a left corner of the container pouring assist system; wherein the front corner of the base is opposite the rear corner of the base; wherein the milk container is inserted through an opening bounded by the collar, the left corner of the base, the rear corner of the base, the right corner of the base, a side support of the plurality of side supports on the left corner of the container pouring assist system, and another side support of the plurality of side supports on the right corner of the container pouring assist system; wherein the container pouring assist system is a covering for a milk container that makes contents of the milk container easier to pour by adding the handle to the bottom rear of the milk container and the spout to the top of the milk container;

wherein the base comprises a bottom panel and base sides;

wherein the base provides support for the bottom of the milk container and prevents the milk container from slipping through the container pouring assist system and falling out of the bottom of the container pouring assist system;

wherein the plurality of side supports couple to a top of the base;

wherein the plurality of side supports are straps that couple the base to the collar;

wherein the plurality of side supports cover container corners at the front, left, and right corners of the base;

wherein the bottom of the plurality of side supports couple to the base;

wherein the top of the plurality of side supports couple to the collar;

wherein the collar is a ring that surrounds a neck of the milk container;

wherein the collar supports an upper end of the plurality of side supports;

wherein the plurality of side supports pull the collar downwards while pulling the base upwards, thus sandwiching the milk container between the collar and the base;

wherein the collar is prevented from sliding down due to the widening of the milk container below the neck;

wherein the base is prevented from lifting due to the bottom panel pressing against the bottom of the milk container;

wherein the handle is a hand hold located on the base at a top of the rear corner of the base;

wherein the handle provides a grasping point to assist in tilting the milk container;

wherein the spout is a nozzle that couples to the top of the milk container to direct the flow of the contents towards the front corner of the container pouring assist system as the contents are poured from the milk container.

2. The container pouring assist system according to claim 1 wherein the bottom panel is a substantially flat panel;

wherein the bottom panel is coupled to the base sides.

3. The container pouring assist system according to claim 2 wherein the base compromise one or more base apertures;

wherein the one or more base apertures are holes that are cut, molded, stamped, or otherwise formed in the bottom panel;

wherein the one or more base apertures allow air to flow into or out of the space between the base and the milk container.

4. The container pouring assist system according to claim 2 wherein the base sides surround the bottom of the milk container when the milk container is installed in the container pouring assist system;

wherein the base sides prevent the milk container from slipping out of the base in a lateral direction.

5. The container pouring assist system according to claim 4

Wherein a bottom edge of the base sides couple to the bottom panel;

wherein the plurality of side supports couple to a top of the base sides at three corners of the base.

6. The container pouring assist system according to claim 5 wherein the plurality of side supports are made from an elastic material such that the plurality of side supports stretch to allow the base to pass over the bottom of the milk container during installation and removal.

7. The container pouring assist system according to claim 6 wherein the handle pivotably couples to the base via a handle hinge.

8. The container pouring assist system according to claim 7 wherein the spout has a circular, ellipsoidal, or triangular cross-section.

9. The container pouring assist system according to claim 7 wherein the spout is configured to attach to the milk container by screwing a threaded base onto the top of the milk container.

10. The container pouring assist system according to claim 9 wherein a spout retainer prevents loss of the spout at times when the spout is removed from the milk container;

wherein the spout retainer retains the spout to the collar.

11. The container pouring assist system according to claim 10 wherein the spout retainer comprises a retaining ring and a retaining strap;

wherein the retaining ring slidably couples to bottom of the spout such that the retaining ring is held onto the spout and the spout rotates within the retaining ring;

wherein one end of the retaining strap couples to the collar;

wherein an opposite end of the retaining strap couples to the retaining ring;

wherein the spout is coupled to the top of the milk container by pivoting the spout on the spout retainer until the threaded base is aligned with the top of the milk container and then screwing the threaded base onto the milk container with the spout free to rotate within the retaining ring while being screwed.

12. The container pouring assist system according to claim 11 wherein the container pouring assist system comprises a cap that covers the end of the spout;

wherein the cap prevents contamination of the contents of the milk container from objects falling into the spout;

wherein the cap prevents spills or splashing of the contents out of the milk container;

wherein the cap inserts into a top end of the spout and provides a top cover that blocks an open end of the spout;

wherein the cap is held in place by an interference fit between the cap and the spout.

13. The container pouring assist system according to claim 12 wherein a cap retainer retains the cap to the spout when the cap is removed from the spout;

wherein the cap retainer couples to the cap at one end of the cap retainer and to the spout at an opposite end of the cap retainer.

* * * * *